United States Patent [19]

Link et al.

[11] 4,249,829

[45] Feb. 10, 1981

[54] DAISY WHEEL TYPEWRITER

[75] Inventors: Manfred Link; Diethelm Puch, both of Nuremberg, Fed. Rep. of Germany

[73] Assignee: Triumph-Adler A.G., Nurnberg, Fed. Rep. of Germany

[21] Appl. No.: 30,632

[22] Filed: Apr. 16, 1979

[30] Foreign Application Priority Data

Apr. 29, 1978 [DE] Fed. Rep. of Germany ..... 2819140

[51] Int. Cl.[3] ..... B41J 1/30

[52] U.S. Cl. ..... 400/144.2; 400/186

[58] Field of Search ..... 101/93.19; 400/144.1, 400/144.3, 186, 187, 211, 215, 370, 372, 377, 378

[56] References Cited

U.S. PATENT DOCUMENTS

| | | | |
|---|---|---|---|
| 2,876,280 | 3/1959 | Griffith | 400/215 X |
| 3,584,722 | 6/1971 | Albrile | 400/213.1 |
| 4,022,313 | 5/1977 | Lau et al. | 400/213.1 |
| 4,147,438 | 4/1979 | Sandrone et al. | 400/144.2 |

*Primary Examiner*—Paul T. Sewell

[57] ABSTRACT

A daisy wheel typewriter wherein wheel positioning to present a character for printing and hammer actuation to effect printing of a selected character are electronically operated in response to keyboard generated signals. Functions associated with a printing action, e.g., ribbon lift, ribbon feed, and carriage spacing, are, however, operated mechanically in synchronism with the electronics by a timing disc driven by a print cycle function actuating shaft. Non-printing service functions are also operated mechanically by conventional powered mechanisms responsive to keyboard generated signals.

3 Claims, 5 Drawing Figures

DAISY WHEEL TYPEWRITER

This invention relates to daisy wheel typewriters; more particularly, it relates to a daisy wheel typewriter having electronically operable print selection and printing mechanisms and mechanically operable print associated functions which are synchronized by timing signals generated upon initiation of a printing cycle by keyboard generated signals.

Daisy wheel printers are generally known and offer advantages relative to type bar and so-called ball typewriters, of faster and quieter operation. Known daisy wheel printers, as disclosed in U.S. Pat. No. 4,058,195, however, employ electronic means to drive and control printing as well as non-printing functions, and are, therefore, expensive; and because of this, notwithstanding they can function as typewriters, they have found their greatest application as system peripheral units, but not as correspondence or office typewriters.

U.S. Pat. No. 3,677,386 is exemplary of daisy wheel typewriters employing electromechanical and mechanical mechanism to meet the economy dictated by an office or correspondence typewriter.

In accordance with the invention, a daisy wheel typewriter is provided with electronically operated and controlled print functions but with mechanically operated print associated functions, as well as non-printing functions, to thereby enable the construction of a relatively inexpensive typewriter having the advantages of electronically driven and controlled daisy wheel typewriters.

An object of the invention is to provide an economical daisy wheel typewriter.

Another object of the invention is in the provision of a daisy wheel typewriter employing electronically and mechanically driven and controlled functions operating in synchronism.

Other objects and many of the attendant advantages of this invention will be readily appreciated as the same becomes better understood by reference to the following detailled description when considered in connection with the accompanying drawing in which like reference numerals designate like parts throughout the Figures thereof and wherein.

Figure 1:
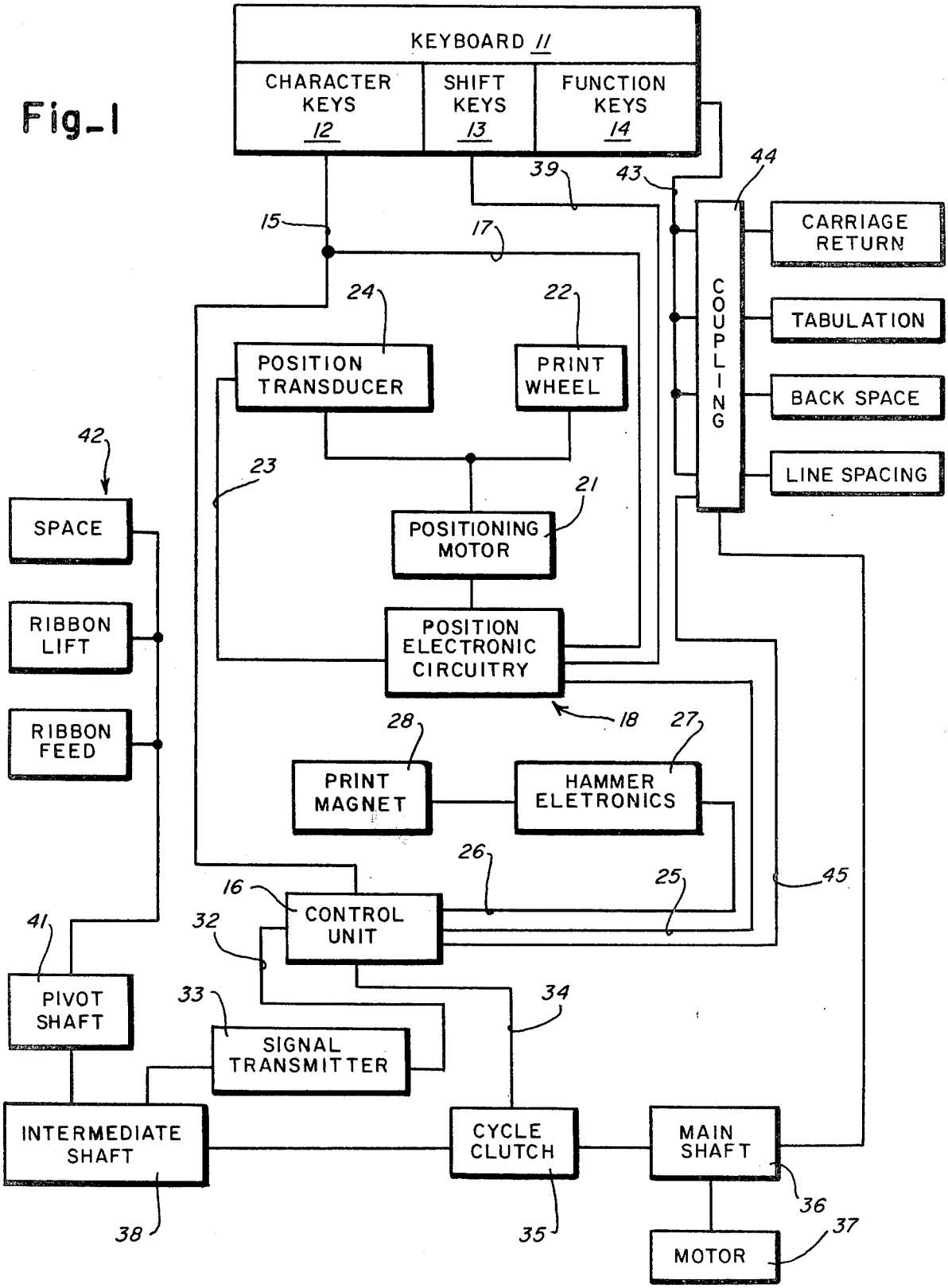
FIG. 1 is a schematic functional block diagram of a typewriter in accordance with the invention.

Referring now to the drawing, there is shown with particular reference to FIG. 1, a keyboard 11, having coded electrical signal generating character typing keys 12 and shift keys 13, as well as non-printing service function keys 14. Coded signals representing operated character typing keys 12 are carried over lines 15 to an electronic control unit 16 and over lines 17 to position electronic circuitry, generally designated 18, for controlling a positioning motor 21 which is connected to rotate a daisy print wheel 22. The position electronic circuitry 18 also receives signals over line 23 from a position transducer 24 which monitors the momentary position of the print wheel 22 to tell the position electronic circuitry 18 when the desired position has been reached. The position electronic circuitry also receives signals over line 25 from the control device 16 to initiate positioning. The control unit 16 also issues signals over line 26 to hammer control electronics 27 which operates a printing or hammer drive magnet 28 to operate a hammer 31 (FIG. 2) located in the printer carriage to print the positioned character.

The control or coordinating unit 16, if a signal on line 32 from a signal transmitter 33 is present indicating a cycle is not in progress, issues, on receipt of a coded signal over line 15, a clutch signal over line 34 to a print cycle clutch 35 to initiate a printing cycle and issues, over line 25, signals to initiate positioning of a selected character. When engaged, the clutch 35 couples a main shaft 36, continuously driven by a motor 37, to an intermediate or control shaft 38. The control shaft 38 drives the signal transmitter 33 and is coupled to oscillate a pivot shaft 41 having actuators 42 thereon for operating functions associated with a print action, e.g., character spacing, ribbon lift and ribbon feed. Upon execution of these associated functions, as made known to the control unit 16 by the signal transmitter 33, the control unit 16 issues signals over line 26 to print the positioned selected character.

The depression of a shift key 13 will generate a shift code, either upper case or lower case, which is carried over line 39 to the position electronic circuitry 18, thereby to position or to condition the position electronics 18 to present an upper case or lower case character according to the placement or arrangement of upper case and lower case characters on the printing wheel 22.

Keys 14 associated with non-printing functions also generate signals, either electrical or mechanical, over lines 43 to couple mechanical actions 44 into driving engagement with the continuously driven main shaft 36 and thereby power operate these functions. To hold in abeyance a print action cycle initiated during a relatively longer time non-printing functions, switches (not shown) associated with the non-printing functions may be provided to issue signals over line 45 to the control unit 16 for as long as these functions are in progress, thereby to delay a clutch cycle.

Figure 2:
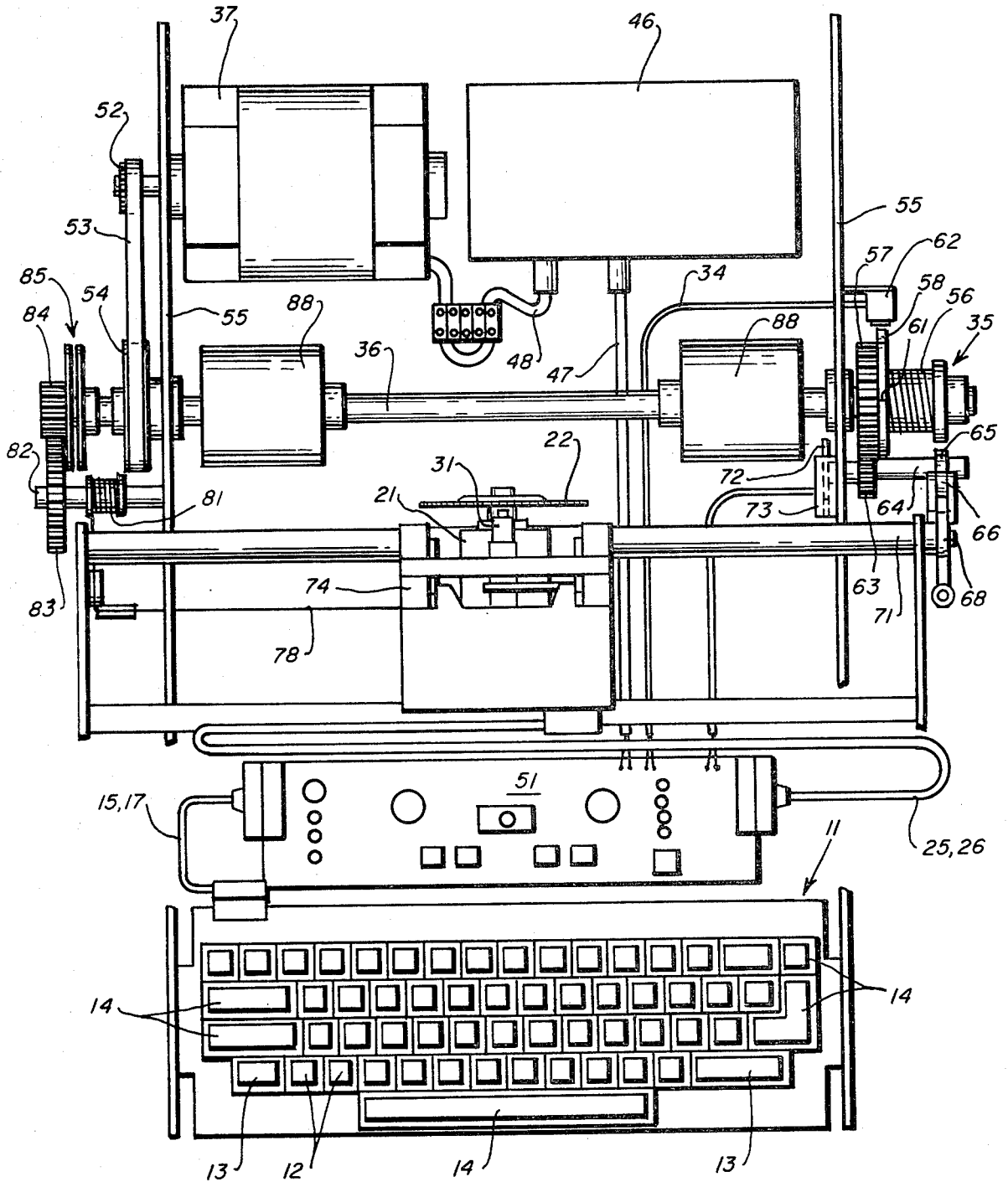
FIG. 2 is a top view of a typewriter in accordance with the invention showing elements for controlling functions associated with a print action and for controlling synchronization of these functions and the print function.

Referring now to FIG. 2 wherein elements generally described with reference to FIG. 1 are shown, the typewriter includes a power supply 46 which supplies power, over buses 47 and 48, respectively, to a printed circuit board 51, incorporating the control unit logic circuitry 16 and position and hammer electronics 18 and 27, and power to drive the main motor 37.

Figure 4:
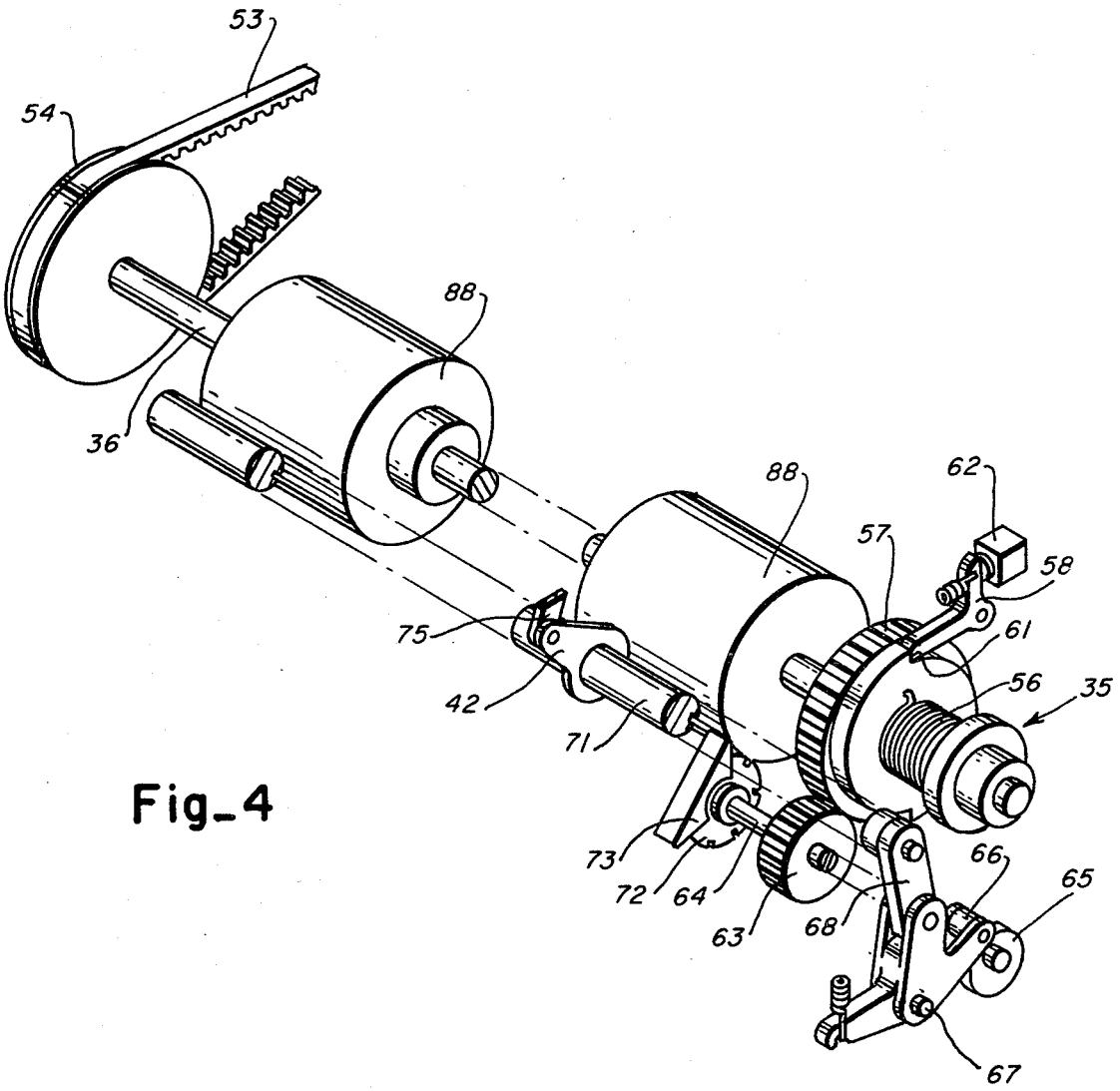
FIG. 4 is a perspective view of control and drive elements shown in FIG. 2.

The main motor 37 drives a gear 52 which is coupled by a belt 53 to continuously drive a gear 54 on the main shaft 36 which is rotatably supported in machine side frames 55. At the right end of the main shaft 36 is the half-revolution print cycle clutch 35 comprising a wrap spring 56, one end of which is driven by the main shaft 36, and the other end of which is secured to an output gear 57 rotatably mounted on the main shaft 36. The wrap spring 56 is normally held unwrapped or disengaged by a gear arresting pawl 58 engaging an abutment 61 on the gear 57. The clutch 35 is engaged and thereby gear 57 is driven when the pawl 58 is withdrawn upon energization of a solenoid 62 by a signal from the control unit 16 on line 34. Clutch output gear 57 is in engagement with a smaller gear 63 on an intermediate or second shaft 64 parallel to the main shaft, thereby to drive shaft 64 for a single revolution each print cycle. With reference to FIGS. 2 and 4, the second shaft 64 carries a cam 65 which engages a cam follower 66 pivotally supported on a frame supported shaft 67. The cam follower 66 operates linkage 68 secured to a third shaft 71, thereby to oscillate said third shaft 71. The second shaft 64 also carries a radially slotted timing disc 72 which, together with slot sensor means 73, comprises the signal transmitter 33 which issues timing signals to the control unit and which, in rest position as hereinbefore noted, issues a not-in-progress signal over line 32 to the control unit 16 whereby, upon receipt by the control unit 16 of a coded character signal on line 15, the control unit 16 will issue a clutch cycle signal to the clutch solenoid 62 over line 34, or hold it in abeyance if a non-printing function is in progress, and will issue signals to the position electronics 18.

In response to timing signals issued from the signal transmitter 33 during a print cycle, the control unit 16, which includes counting means, issues signals at the proper time to the hammer drive electronics 27.

Figure 3:
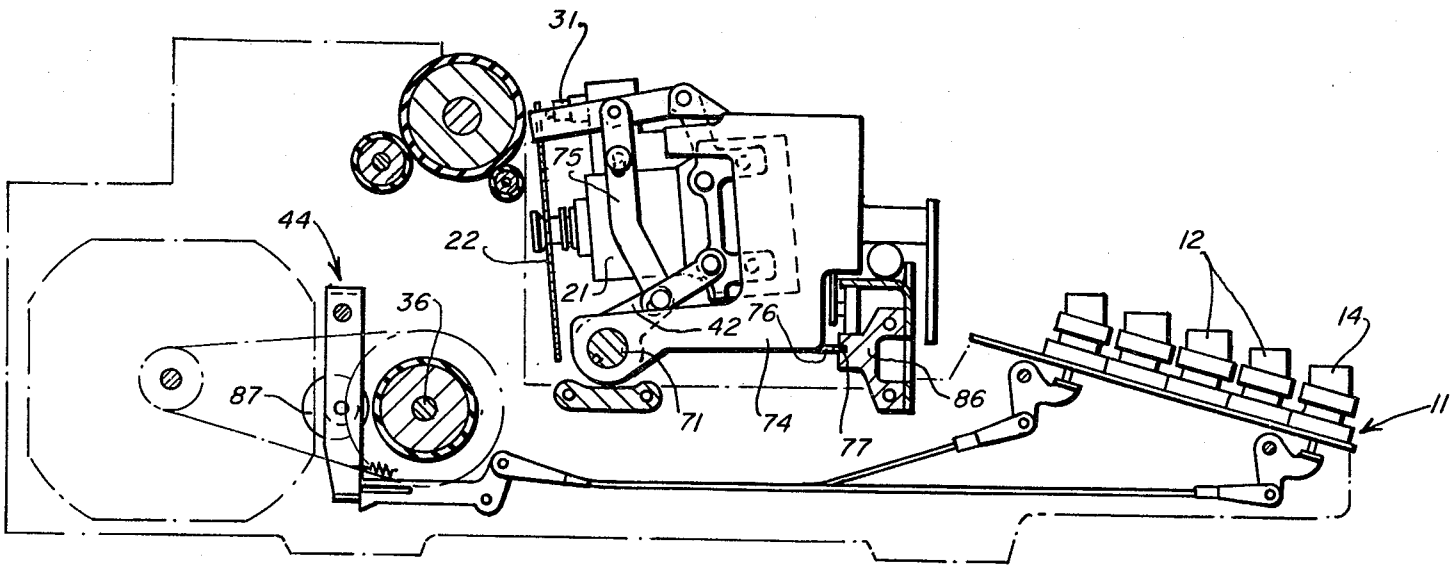
FIG. 3 is a cross-sectional view of the typewriter of FIG. 2.

As shown in FIG. 3, the third shaft 71 extends through a printing element carriage 74 and is keyed thereto as will allow the carriage 74 to move relative thereto in writing and carriage return directions. The carriage 74 mounts the positioning motor 21, daisy print wheel 22, hammer 31, and drive magnet therefor. It also carries ribbon lift mechanism 75, as well as ribbon transport and escapement pawl control mechanism (not shown) for disengaging a pawl 76 from escapement rack 77 fixed to the machine frame. As shown in FIG. 2, the carriage 74 is urged in a writing direction by a conventional cable system 78 (partially shown) wound about a spring drum 81 which is mounted on a shaft 82. Shaft 82 carries a gear 83 in mesh with a carriage return output gear 84 rotatably mounted on the main shaft 36 and couplable thereto upon actuation of a carriage return clutch, generally designated 85. As shown in FIG. 3, the printing element carriage 74 is supported for longitudinal movement on a bearing rail 86 fixed to the machine frame which incorporates the escapement rail 77.

As shown in FIGS. 3 and 4, when the third shaft 71 is oscillated, it operates the print associated function actuators 42 in the form of crank arms secured thereto which will operate the escapement pawl control mechanism, ribbon transport and ribbon lift mechanism 75, all of which may be conventional.

Figure 5:
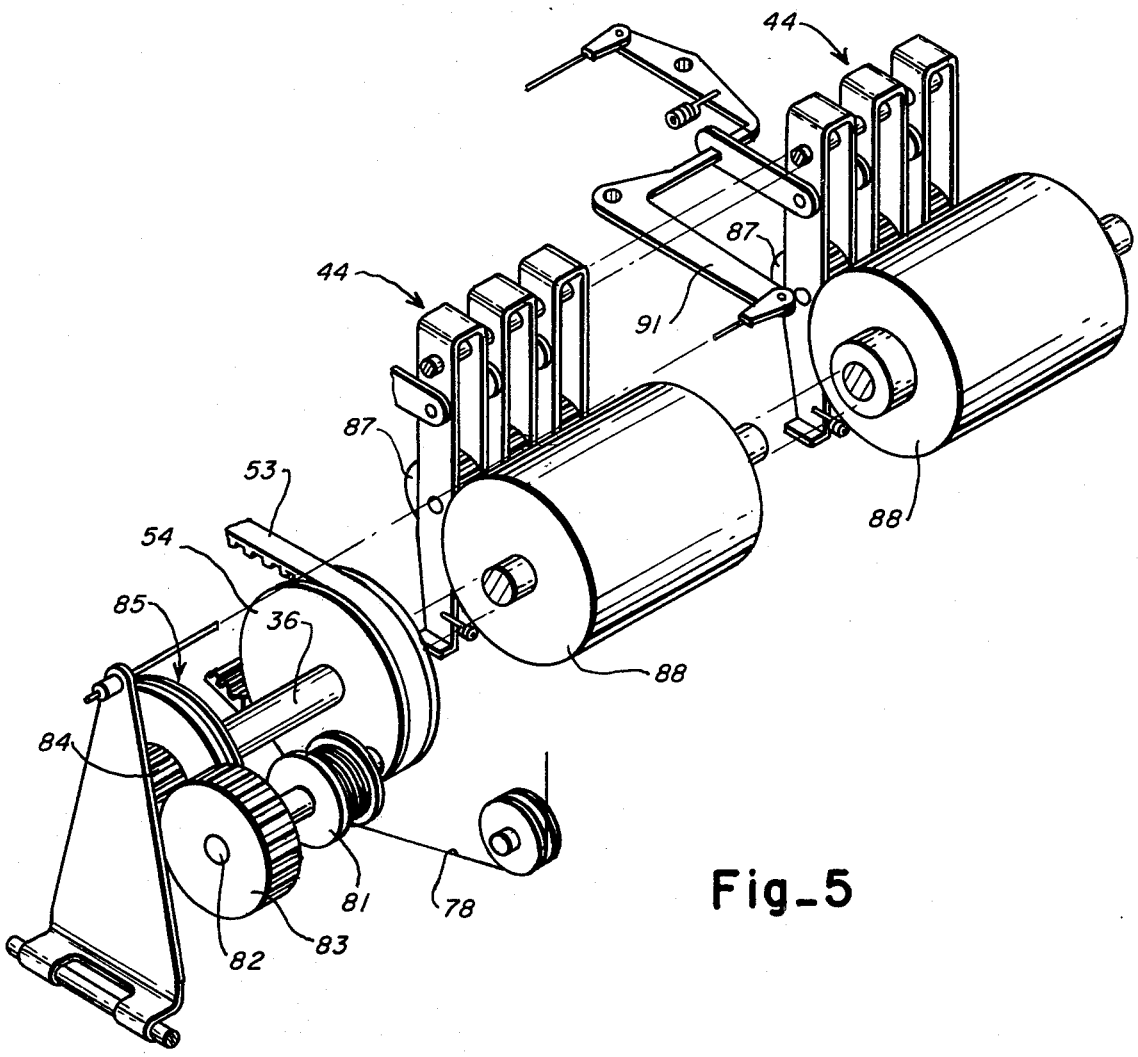
FIG. 5 is a perspective view of drive and control elements for non-printing service functions.

With reference to FIGS. 3 and 5, function keys 14 are shown mechanically linked to release function actions generally designated by reference 44 whereby cams 87, rotatably supported thereon, will engage friction power rolls 88 secured to the main shaft 36, thereby to operate various function linkages, e.g., carriage return linkage 91, connected to the actions 44. The function keys 14 may alternatively effect switch closures to generate electrical signals for energizing electromagnets to release the function actions 44 into the friction power rolls 88.

As hereinbefore noted, switches (not shown), operative by any of the function actions, may be employed to signal the control unit 16 that a function is in progress so that the control unit 16 will hold in abeyance a clutch signal until the function is completed.

The particulars of the control unit electronics as well as the electronics for driving and controlling positioning and print actuation are generally known to the art and, per se, form no part of the invention.

The invention claimed is:

1. A typewriter having a daisy wheel printing element positionable to present a selected type character on said wheel for printing, a keyboard for generating type character selection signals, a daisy wheel positioning motor, positioning electronics connected to the output of said keyboard and responsive when enabled by a positioning initiating control signal to energize said positioning motor thereby to present for printing selected type characters corresponding to keyboard generated type character selection signals applied thereto, hammer electronic means operable when enabled by a hammer control signal for driving a selected type character presented for printing to print, a first continuously rotatable shaft, a second control shaft, signal transmitter means on said second control shaft for generating timing signals, electronic control means responsive to keyboard generated type selection signals and to said timing signals for issuing cycle initiating, positioning initiating and hammer control signals, cycle clutch means responsive to a cycle initiating control signal for coupling said first shaft to said control shaft, a third shaft, means responsive to rotation of said second shaft for oscillating said third shaft, and means on said third shaft for operating print associated mechanisms controlling ribbon elevation, ribbon feed, and escapement, said hammer control signal issuing after operation of said print associated mechanisms.

2. A typewriter as recited in claim 1, said keyboard including non print associated function keys, non print function actuator means engageable with said first continuously rotating shaft in response to operation of said non print associated keys, and means connected to disable said electronic control means while a non print associated function is in progress.

3. A typewriter as recited in claim 1, said signal transmitting means comprising a slotted timing disc on said second control shaft, and means for sensing timing slots on said disc and for transmitting timing signals to said electronic control means to control the times of issuance therefrom of said control signals.

* * * * *